US006302199B1

(12) United States Patent
Hawkins et al.

(10) Patent No.: US 6,302,199 B1
(45) Date of Patent: Oct. 16, 2001

(54) MECHANISM FOR DROPPING A PLURALITY OF BALLS INTO TUBULARS USED IN DRILLING, COMPLETION AND WORKOVER OF OIL, GAS AND GEOTHERMAL WELLS

(75) Inventors: Samuel P. Hawkins, Mineral Wells, TX (US); Burney J. Latiolais, Jr.; Keith T. Lutgring, both of Lafayette, LA (US)

(73) Assignee: Frank's International, Inc., Houston, TX (US)

( * ) Notice: Subject to any disclaimer, the term of this patent is extended or adjusted under 35 U.S.C. 154(b) by 0 days.

(21) Appl. No.: 09/559,241

(22) Filed: Apr. 26, 2000

Related U.S. Application Data

(60) Provisional application No. 60/132,044, filed on Apr. 30, 1999.

(51) Int. Cl.[7] ..... E21B 33/068

(52) U.S. Cl. ..... 166/70; 166/75.15; 137/268

(58) Field of Search ..... 166/75.15, 70; 137/268; 15/104.062

(56) References Cited

U.S. PATENT DOCUMENTS 597,185 * 1/1898 Buebner ..... 15/104.062
2,713,909 * 7/1955 Baker ..... 166/70
2,955,654 * 10/1960 Stogner et al. ..... 166/75.15
3,039,531 * 6/1962 Scott ..... 166/70
3,063,080 * 11/1962 Bergman et al. ..... 15/104.062
3,146,477 * 9/1964 Bergman et al. ..... 15/104.062
4,491,177 * 1/1985 Baugh ..... 166/75.15
5,188,178 * 2/1993 Noyes ..... 166/310
5,277,248 * 1/1994 Breland ..... 166/70
6,056,058 * 5/2000 Gonzalez ..... 166/310

* cited by examiner

*Primary Examiner*—Hoang Dang
(74) *Attorney, Agent, or Firm*—The Matthews Firm

(57) ABSTRACT

A housing is attached to a tubular sub located within a tubing string suspended in an earth borehole, the connection being an angled ball channel connected between the housing and the tubular sub. A ball carrier is provided within the interior of the housing which can be moved in two opposite directions either using pneumatic or hydraulic pressure against one or two pistons. The ball carrier can have either two balls or three balls. The movement of the ball carrier by the applied pressure causes one of the pockets holding the balls to be aligned with the ball channel which allows the balls to be successively dropped into the ball channel and thus into the interior of the tubing string. The ball carrier includes a sequencing apparatus for providing and ensuring that the balls are dropped in the proper sequence.

12 Claims, 3 Drawing Sheets

MECHANISM FOR DROPPING A PLURALITY OF BALLS INTO TUBULARS USED IN DRILLING, COMPLETION AND WORKOVER OF OIL, GAS AND GEOTHERMAL WELLS

RELATED APPLICATIONS

This application claims priority from United States Provisional Patent Application Ser. No. 60/132,044, filed Apr. 30, 1999.

FIELD OF INVENTION

This invention relates generally to equipment used in the drilling, completion and workover of subterranean wells and more specifically, to equipment for use in oilfield tubulars, for example, in casing strings which are cemented in place in earth boreholes drilled into earth formations.

BACKGROUND

The process of drilling subterranean wells to recover oil and gas from reservoirs consists of boring a hole in the earth down to the petroleum accumulation and installing pipe from the reservoir to the surface. Casing is a protective pipe liner within the wellbore that is cemented into place to ensure a pressure-tight connection of the casing to the earth formation containing the oil and gas reservoir. The casing typically is run a single joint at a time as it is lowered into the wellbore. Tubulars other than casing are also used in the drilling, completion and workover of such wellbores, for example, drill pipe, completion tubing, production tubing, and the like. Moreover, various pieces of downhole equipment utilize balls which, when dropped through such tubulars, are activated by such balls, especially by using the pressure of fluid pumped from the earth's surface at predetermined values to cause such activation. For example, it is well known to drop a ball from the earth's surface down through a tubular onto a seat having a diameter less than the diameter of the dropped ball. An increase in the pumped pressure causes some element of the downhole equipment to be activated. Without limiting the foregoing, such activation may include the movement of a sleeve, the opening or closing of a port, the movement of a valve, the fracturing of a frangible disk, the release of elastomeric cement wiper plugs, the control of downhole packers, etc.

The controlled dropping of one or more balls into the top portion of a tubular at the earth's surface is therefore very important, both as to the diameter of the ball or balls, and the timing of the release of the ball or balls.

BRIEF DESCRIPTION OF THE DRAWINGS

FIG. 1 illustrates, pictorially, the overall apparatus for practicing the present invention. The apparatus includes a ball-dropping assembly 64 (shown in more detail in FIG. 2), and a cement port 66 which can be used in cementing operations.

Referring now to FIG. 2, the ball-dropping apparatus 64 is shown in greater detail. The apparatus 54 is a two-ball device, in which two round balls of different diameters 68 and 70 are located in a movable ball carrier 72. An air cylinder plunger 74, passing through an air cylinder seal 75, has a first end attached to the ball carrier 72 and a second end attached to a piston 76 which moves within the cylinder 78. A return spring 80 is connected between the piston 76 and the end wall of cylinder 78. A second return spring 82 is connected between the other end of the ball carrier 72 and the other end of the chamber 78a within the interior of the apparatus 64. A pressure source, either pneumatic or hydraulic (not illustrated), is connected to the port 88 and the same pressure source, if desired, is connected to the port 90, enabling the piston 76 to be moved in either direction.

Figure 1:
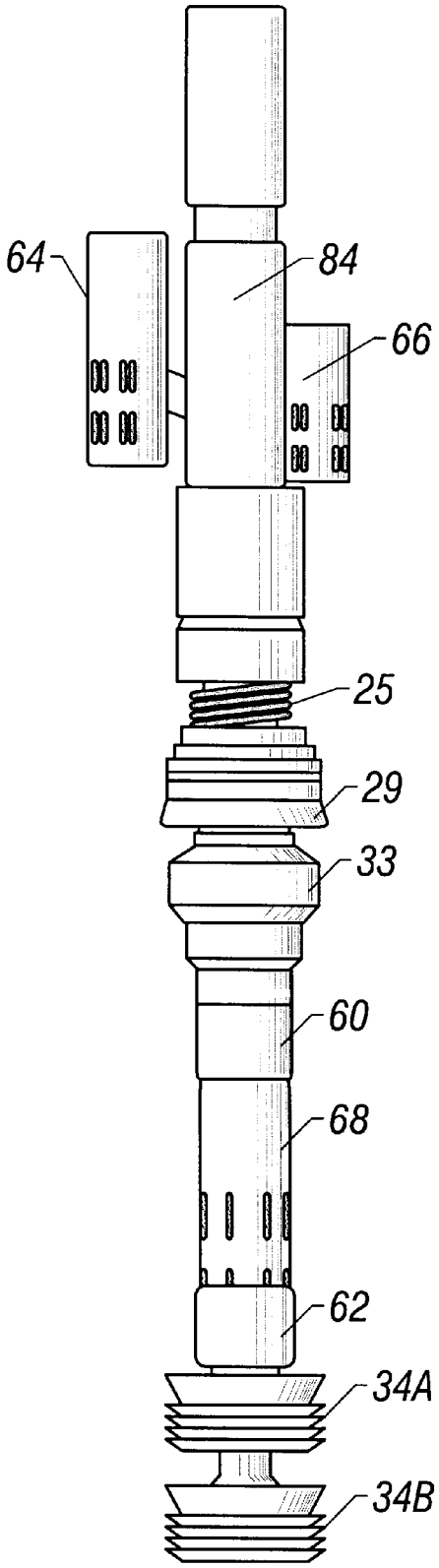
FIG. 1: Illustrates an elevated, pictorial view of an example of a downhole apparatus which can be activated by dropping one or more balls, followed by increasing the pressure of fluid pumped from the earth's surface.
Figure 2:
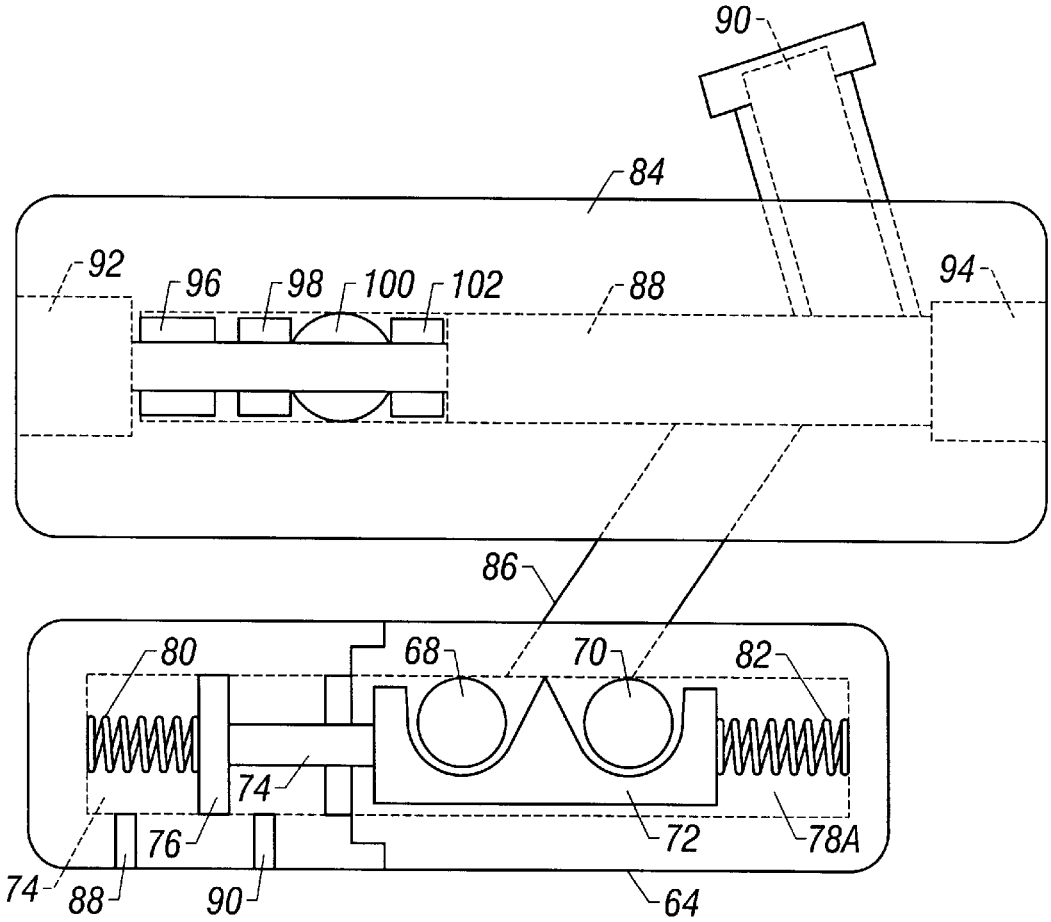
FIG. 2: Illustrates a two-ball, ball-dropping mechanism, according to the present invention.

A sub 84, located within the tubular string as illustrated in FIG. 1, immediately across from the apparatus 64, has a tubular ball port 86 through which the balls 68 and 70 can be dropped into the interior passage 88 of the sub 84. The sub 84 also includes a pump-in port 90 in fluid communication with the passage 88 and a pair of threaded box connections 92 and 94 at opposite ends of the sub 84. Also included in passage 88 is a valve retainer sleeve 96, a lower valve seal 98, a ball valve 100, and an upper valve sleeve 102.

In the operation of the sub 84 and the ball-dropping apparatus 64, the fluid being used to fill-up, circulate, cement, or otherwise pump fluid downhole through the tubulars, is pumped through the top opening 92 of the sub 84, through the open ball valve 100 and out through the exit port 94 and down to the interior of the tubular string (not illustrated). When it is desired to drop one or both of the balls 68 and 70 into the passage 88, the ball valve 100 is rotated to the closed position. Pressure is then applied, for example, through a two-position rotary valve (not illustrated), to either end of the input ports 88 or 90, to push the piston 76 one way or the other. For example, if it is desired to drop the smaller diameter ball 70, pressure is applied to port 90, causing piston 76 to compress spring 80 and to move the ball carrier 72 and the ball 70 into alignment with the ball port 86. As soon as ball 70 drops into the passage 88, pressure can be applied through the pump-down port 90 to pump the ball 70 out through the exit port 94 into the tubular string below. When normal circulation is desired, the ball valve 100 can be returned to its open position. When desired to drop the larger diameter ball 68, the procedure can be reversed by applying pressure to the port 88, which causes the spring 82 to be compressed, the ball carrier 72 to be moved, and the ball 68 to be aligned with the ball port 86.

Figure 3:
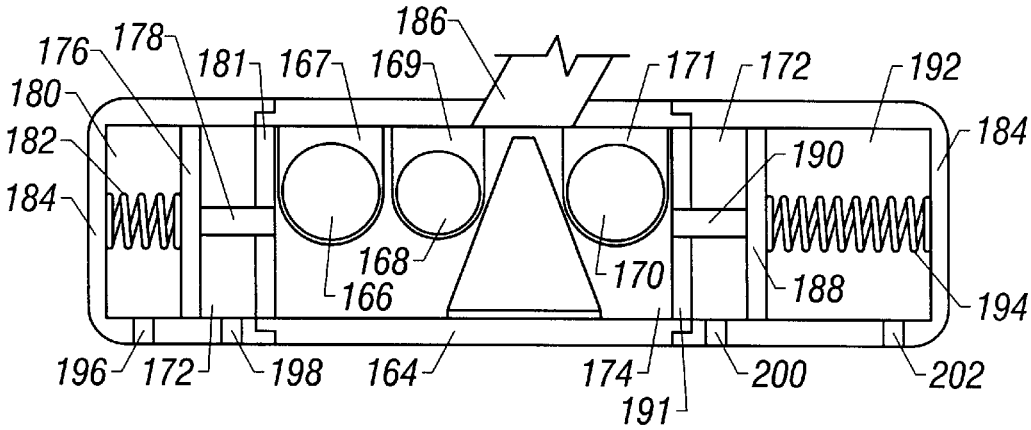
FIG. 3: Illustrates a three-ball, ball-dropping mechanism according to the present invention.

FIG. 3 illustrates, schematically, an alternative embodiment of a ball-dropping mechanism 164 which can be used to drop three different diameter balls 166, 168 and 170 through the ball port 186. The ball port 186 is coupled into the sub 84 illustrated in FIG. 1, and in so doing, the ball-dropping mechanism 164 substitutes for the two ball, ball-dropping mechanism 64.

The ball-dropping mechanism 164 has an interior chamber 172 through which a ball carrier 174 can traverse to align the receptacles 167, 169 and 171 with the ball port 186. A first piston 176 having a shaft 178 attached to one end of the ball carrier 174 and passing through a seal 181, is adapted to traverse the cylinder 180, the cylinder 180 merely being the end portion of the chamber 172. A return spring 182 is connected between the piston 176 and the outer housing 184.

A second piston 188 having a shaft 190 attached to a second end of the ball carrier 174 and passing through a seal 191, is adapted to traverse the cylinder 192, which also is merely the other end of the chamber 172. A return spring 194 is connected between the piston 188 and the outer housing 184, surrounding the chamber 172.

A pair of ports 196 and 198 are provided in the housing 184 on opposite sides of the piston 176 to allow a conventional pressure source (not illustrated), usually pneumatic, to drive the piston 176 one way or the other. Similarly, a second pair of piston ports 200 and 202 are provided in the housing 184 on opposite sides of the piston 188 to allow a conventional pressure source (not illustrated) to drive the piston 188 one way or the other. For example, if it is desired to align the ball 168 and the receptacle 169 with the ball port 186, air pressure can be applied to the ports 200 and 196 while venting the ports 202 and 198 to the atmosphere to complete the desired alignment and drop the ball 168 into the ball port 186.

To drop the second largest ball 170, the process is reversed by venting ports 196 and 200 to the atmosphere while applying air pressure to ports 198 and 202. Until the ball 170 is dropped, and while residing in the receptacle 171, the ball 170 in conjunction with a safety pin 195, described in detail in FIG. 6, limits the movement of the ball carrier 174 so that as between balls 170 and 166, only the ball 170 can be aligned to drop into the ball port 186. Once the ball 170 has been dropped, the safety pin no longer limits the movement of the carrier 174, allowing the largest ball 166 to be aligned and dropped into the ball port 186.

Figure 4:
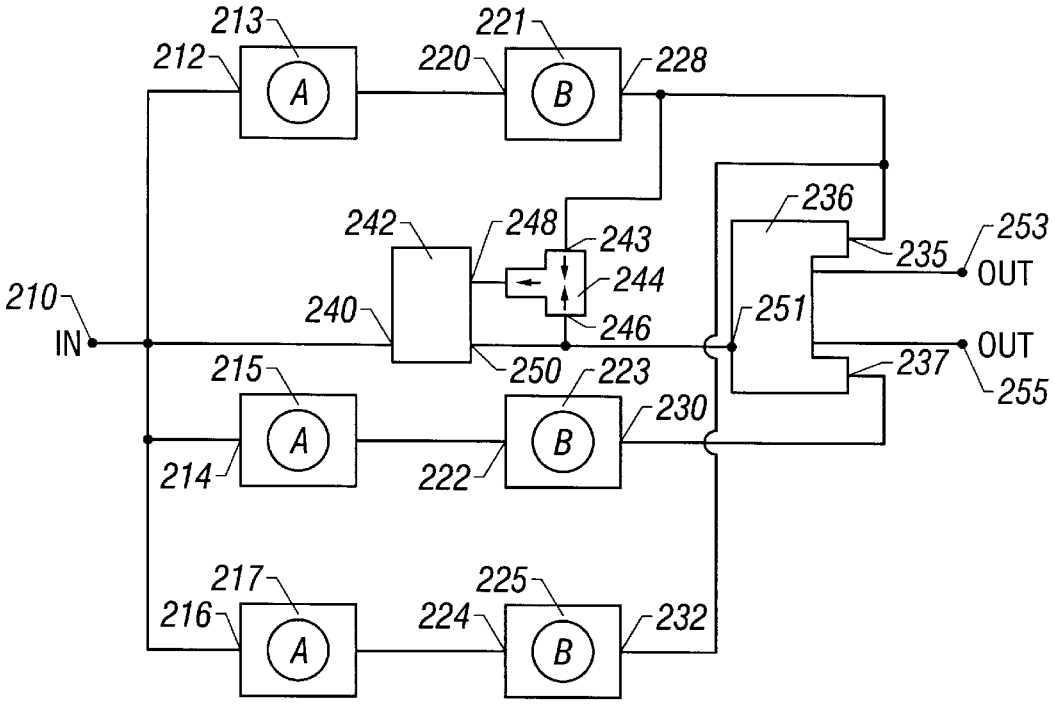
FIG. 4: Illustrates a pneumatic circuit which is used to control the ball-dropping mechanism of FIG. 3.

Referring now to FIG. 4, there is illustrated a pneumatic circuit for controlling the three ball, ball dropping mechanism illustrated in FIG. 3. A conventional source of air pressure (not illustrated) is connected to the input line 210 which, in turn, is connected to inputs 212, 214 and 216 of actuating "A" valves 213, 215 and 217 respectively. The outputs of valves 213, 215 and 217 are connected to the inputs 220, 222 and 224 of actuating "B" valves 221, 223 and 225 respectively. The outputs 228 and 232 of the valves 221 and 225 are tied together and connected into one input 235 of a two-position pneumatic valve 236. The output 230 of valve 223 is connected into a second input 237 of valve 236.

The input 210 is also connected to an input 240 of a pneumatic valve 242. The output 228 of valve 221 is connected into an input 244, whose output is connected to a second input 248 of valve 242. The output 250 of the valve 242 is connected to a second input 246 of switch 244.

In the operation of the pneumatic circuit of FIG. 4, used to control the dropping of the three balls 166, 168 and 170 in FIG. 3, it should be appreciated that the spring-loaded, push-on pneumatic valves 213 and 221 control the drop of the smaller ball 166. Neither the valve 213 nor the valve 221 will allow the pressurized air to pass through unless the buttons "A" and "B" are depressed. The switch 244 allows pressurized air into input 243 and input 246. The output of the switch 244 is coupled into the input 248 of pneumatic valve 242.

Upon the simultaneous depression of the "A" and "B" buttons of valves 213 and 221, pressurized air is found at the input 243 of valve 244, and at the input 248 of valve 242, causing the valve 242 to open and allowing pressurized air to flow from input 240 to output 250. This causes pressurized air to flow into the input 246 of switch 244 and into input 248 on valve 242, causing valves 242 to remain open even when the "A" and "B" buttons of valves 213 and 221 are no longer depressed.

The pressurized air from output 250 of valve 242 is also found at input 251 of the pneumatic valve 236, a two-position valve which supplies pressurized air either from output 253 or output 255, but not both simultaneously.

The output 253 of FIG. 4 is connected to the port 196 in FIG. 3. The output 255 of FIG. 4 is connected to the port 202 of FIG. 3.

Thus, the system of FIGS. 3 and 4 have the feature that in dropping the three balls, 166, 168 and 170, only the smallest ball 168 can be dropped first. If the "A" and "B" buttons of valves 215 and 223, and/or the "A" and "B" buttons of valves 217 and 225 are depressed first, by accident or otherwise, nothing will happen because the pressurized air is blocked from passing through the valve 242 and hence, through the valve 236.

However, once the valves 213 and 221 are opened, the pressurized air passes through valve 236, out through its output 253 to the port 196, moving the ball carrier 174 into alignment with the ball port 186 to drop the smallest ball 168. Because the valve 242 remains open, the second and third balls 170 and 166 can be successively dropped.

As another fail-safe feature, because of the safety pin which protects the ball carrier 174 from moving far enough to allow the ball 166 to be dropped, the largest ball 166 cannot be dropped before the ball 170 is dropped.

To drop the ball 170, the "A" and "B" buttons of valves 214 and 222 are depressed, causing the pressurized air to flow from the output 255 of valve 236, and into the port 202. This causes the ball carrier 174 to move laterally, aligning the ball 170 with the ball port 186, causing the ball 170 to be dropped.

Because ball 170 is now dropped, the safety pin no longer hinders the movement of the ball carrier 174. By depressing "A" and "B" buttons of valves 217 and 225, the pressurized air from input 251 is passed out through the output 253 of valve 236, connected to the port 196, which causes the ball carrier to move laterally, to align the largest ball 166 with the ball port 186.

Thus, FIGS. 3 and 4 provide a fail-safe, fully automated system to successively drop these different sized balls into a tubular string. Preferably, this involves first the smaller ball, i.e., having a 1-3/8" diameter, and second, the next larger ball, i.e., having a 1-5/8" diameter, and third, the largest ball, i.e., having a 1-7/8" diameter. However, the apparatus of FIG. 3 can easily be modified to change the sequence, for example, to allow either the larger ball or the next larger ball to be dropped first, merely by swapping the receptacles 167, 168 and 171, and the balls 166, 168 and 179 therein respectively, in any order desired.

Figure 5:
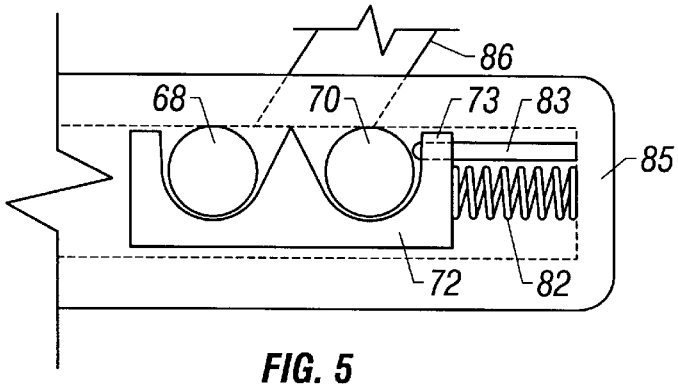
FIG. 5: Illustrates a safety pin for ensuring that the smaller ball has to be dropped first.

Referring now to FIG. 5, a safety pin 83 is illustrated as being connected to the end wall 85 of housing 84. The pin 83 is slidably moveable through the sidewall 73 of the pocket containing the ball 70, and protrudes slightly into the pocket space.

In the operation of the safety pin 83, the ball carrier can not be moved down to drop the ball 68 because of the ball 70 pushing against the end of the pin 83. Once the ball 70 has been dropped, the ball carrier 72 can move along the length of the pin 83 to align the ball 68 with the ball channel 86 to cause the ball 68 to drop into the tubular sub 84.

Figure 6:
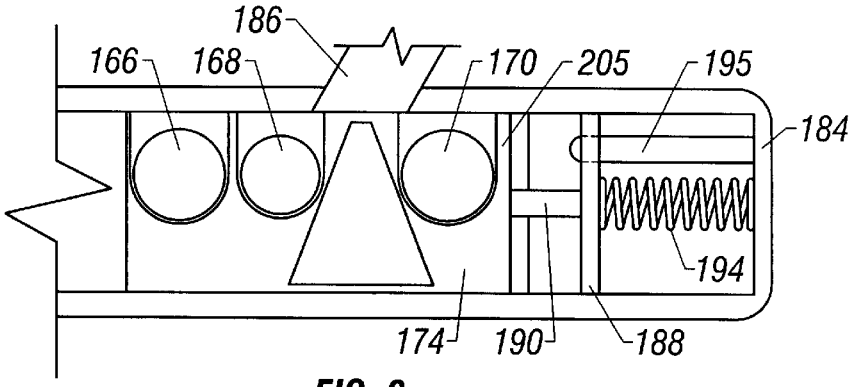
FIG. 6: Illustrates a safety pin for ensuring that the smaller ball has to be dropped first, then the next larger ball, then the largest ball.

In a similar, but slightly different mode, the safety pin 195 illustrated in FIG. 6 is connected to the wall and protrudes slightly through the piston 188.

In the operation of the safety pin 195, the ball carrier 174 is moved down to align the ball 168 with the ball channel 186. The safety pin 195 extends through the end wall 205 to protrude slightly into the pocket 171 and against the side of ball 170. This action prevents the ball carrier from being moved far enough to drop ball 166. However, by moving the ball carrier to align the ball 170 with the ball channel 186, and thus causing the ball 170 to drop, the pin 195 can protrude further into pocket 171 and allow ball 166 to be dropped.

What is claimed is:

1. A mechanism for dropping at least one ball from or near the earth's surface into a tubular string suspended in an earth wellbore, comprising;

a housing positioned outside said tubular string, said housing being connected to said tubular string by a ball channel angled downwardly from said housing to said tubular string;

a ball carrier moveable within said housing, said moveable carrier having a plurality of linerarley arranged pockets sized to hold a plurality of balls in a linear pattern;

an exit port in said housing allowing said at least one ball to exit said housing into said conduit responsive to a change of position of said moveable carrier within said housing.

2. The mechanism of claim 1, wherein said ball carrier has first and second pockets for holding first and second balls, respectively.

3. The mechanism of claim 1, wherein said ball carrier has first, second and third pockets for holding first, second and third balls, respectively.

4. The mechanism of claim 1, including in addition thereto, a piston having a shaft attached to one end of said ball carrier, and said piston being controllable by fluid pressure to be moved in two directions.

5. The mechanism of claim 1, including in addition thereto, first and second pistons, the first of said pistons having a first shaft attached to a first end of said ball carrier and a second piston having a second shaft attached to a second end of said ball carrier, each of said pistons being controllably moveable by fluid pressure in two directions.

6. The mechanism according to claims 4 or 5, including in addition thereto, means for ensuring that a given ball can not be dropped until a different ball has already been dropped.

7. A system for dropping at least one ball from at or near the earth's surface into a tubular string suspended in an earth wellbore, comprising:

a tubular sub adapted to be connected into a tubular string;

a housing positioned outside said tubular string;

a ball channel having first and second ends, said first end being connected to said tubular sub, and said ball channel being angled upwardly from said tubular string towards said housing, whereby a ball dropped into the second end of said ball channel will travel through said ball channel and enter the interior of said tubular sub;

a ball carrier moveable within said housing, said moveable carrier having a plurality of linearly arranged pockets sized to hold a plurality of balls in a linear pattern;

an exit port in said housing connected to the second end of said ball channel, allowing said at least one ball to exit said housing responsive to a change of position of said moveable carrier within said housing.

8. The mechanism of claim 7, wherein said ball carrier has first and second pockets for holding first and second balls, respectively.

9. The mechanism of claim 7, wherein said ball carrier has first, second and third pockets for holding first, second and third balls, respectively.

10. The mechanism of claim 7, including in addition thereto, a piston having a shaft attached to one end of said ball carrier, and said piston being controllable by fluid pressure to be moved in two directions.

11. The mechanism of claim 7, including in addition thereto, first and second pistons, the first of said pistons having a first shaft attached to a first end of said ball carrier and a second piston having a second shaft attached to a second end of said ball carrier, each of said pistons being controllably moveable by fluid pressure in two directions.

12. The mechanism according to claims 10 or 11, including in addition thereto, means for ensuring that a given ball can not be dropped until a different ball has already been dropped.

* * * * *